US012173606B2

(12) United States Patent
Zhang et al.

(10) Patent No.: US 12,173,606 B2
(45) Date of Patent: Dec. 24, 2024

(54) MULTI-STAGE CONTROL NEGATIVE POISSON SELF-EXPANDING ANCHOR APPARATUS

(71) Applicant: North China University of Water Resources and Electric Power, Henan (CN)

(72) Inventors: Xingsheng Zhang, Henan (CN); Jinyu Dong, Henan (CN); Weihua Li, Henan (CN); Mengke Hu, Henan (CN); Xinglong Yang, Henan (CN); Xing Chen, Henan (CN); Yawen Zhao, Henan (CN)

(73) Assignee: North China University of Water Resources and Electric Power, Zhengzhou (CN)

( * ) Notice: Subject to any disclaimer, the term of this patent is extended or adjusted under 35 U.S.C. 154(b) by 192 days.

(21) Appl. No.: 17/951,947

(22) Filed: Sep. 23, 2022

(65) Prior Publication Data

US 2023/0097145 A1 Mar. 30, 2023

(30) Foreign Application Priority Data

Sep. 29, 2021 (CN) ..... 202111155190.0

(51) Int. Cl.
*E21D 21/00* (2006.01)

(52) U.S. Cl.
CPC ..... *E21D 21/008* (2013.01); *E21D 21/0033* (2013.01)

(58) Field of Classification Search
CPC ..... E21D 21/008; E21D 21/0033
See application file for complete search history.

(56) References Cited

U.S. PATENT DOCUMENTS

| | | | | |
|---|---|---|---|---|
| 3,082,578 A * | 3/1963 | Lindstaedt | ..... | E21D 20/021 29/445 |
| 4,472,088 A * | 9/1984 | Martin | ..... | E21D 21/0026 52/704 |
| 4,896,416 A * | 1/1990 | Cranko | ..... | F16B 13/0841 29/525.04 |
| 6,273,655 B1 * | 8/2001 | McAlpine | ..... | F16B 13/0841 411/72 |
| 6,929,424 B2 * | 8/2005 | Hindle | ..... | E21D 21/004 405/259.4 |

* cited by examiner

*Primary Examiner* — Janine M Kreck

(57) ABSTRACT

The present disclosure is related to a multi-stage control negative Poisson self-expanding anchor apparatus. The apparatus is constructed to solve the problem of poor effect or even failure of anchor bolts owing to insufficient force area of the bolt and easy damage of the locking section under the action of large tension in the existing technology. The anchorage section mainly comprises a plurality of circular platform bodies spaced with larger outward and smaller inward along the axial direction. The axial inner segment of the round platform body is coaxial connected with the force resistant body, and the axial outer segment of the round platform body is opened with an axial inward through the hole of the force resistant body. The axial inner part of the force resistant body is fixed on the anchorage segment.

7 Claims, 9 Drawing Sheets

MULTI-STAGE CONTROL NEGATIVE POISSON SELF-EXPANDING ANCHOR APPARATUS

CROSS-REFERENCE TO RELATED APPLICATION

This application claims priority the Chinese patent application 202111155190.0 filed Sep. 29, 2021, the content of which is incorporated herein in the entirety by reference.

TECHNICAL FIELD

The present disclosure relates to the field of a multi-stage control anchor, and in particular, a piecewise displacement multi-stage control negative Poisson self-expanding anchor apparatus.

BACKGROUND

Anchors are widely used in slope protection engineering. Its main function is to control surface works, such as slopes and deep foundation pits, and well as underground chamber works, such as tunnels and stopes.

In some areas where grade of surrounding rock is relatively low, such as soft rock areas, the surrounding rock is prone to large deformation. Under the action of earthquakes, the surrounding rock often undergoes large deformation. In addition, the factors that cause large deformation are loads, etc. In the work, the bolt is used as the surrounding rock support structure, and the number of applications is the largest and the most extensive.

In most of existing technologies, a rigid anchor is directly anchored at the bottom of the anchor hole, and then the tray is pressed on outside of the slope through a screw nut screwed on the anchor. Two stress points of anchor structure are the anchorage segment and the stress point between the outside side of the slope and the screw nut tray. The external stress point is exposed to the outside for a long time, the screw nut and tray are easy to rusty and damaged. On the other hand, the external side of the slope is easy to crack under long-term stress, causing the anchor to lose the displacement requirement of slope, or even failure. In addition, due to the deep anchor hole, the deformation between the anchorage segment and the outside side of the slope may occur at different depths. For the traditional anchor bolt, no matter the deformation at any depth, external screw nuts and trays are required to bear the force, and long-term use is also easy to cause anchorage failure.

SUMMARY

To overcome the drawbacks of conventional anchoring technologies, the objective of the present disclosure is to provide a multi-stage control negative Poisson self-expanding anchor apparatus for slope protection, wherein the multi-stage control negative Poisson self-expanding anchor apparatus effectively solves the problem of inadequate anchorage stress area of the anchor and invalidation of the anchorage section.

Accordingly, to accomplish the above subject, the present disclosure includes a plurality of axial outward larger and inward smaller round platform bodies, wherein these round platform bodies are coaxial connected with the force resistant body and the innermost force resistant body is fixed on the anchorage segment, a hole is arranged in the force resistant body, a sleeve covers around the force resistant body, and the sleeve comprises a plurality of slots extending toward the inner axial side; the inner sleeve is linked to the anchorage segment with an elastic body, and the other sleeve is linked to the platform body with an elastic body.

Preferably, a screw is fixed at the center of the anchorage segment, wherein the screw passes through the hole in the axially outermost round platform body toward the axial outer side, a tray is arranged on the part of the screw, and a screw nut is screwed on the screw on the outer axial side of the tray.

Preferably, the anchorage section is anchored in the most inner of the anchor hole, the side wall of the sleeve with the axial inner side of the slot is fixed on the wall of the anchor hole, and the inner wall of the anchor hole at the slot is attached to the sleeve.

Preferably, the elastic force body is a spring, and the round platform and force resistant bodies are integrated into one structure.

Preferably, the force resistant body comprises an insertion part with a through-hole and a transition portion connected to the outer end of the insertion portion. The diameter of the outer end of the transition portion is equal to the diameter of the outer end of the innermost resistant body, and the outer end of the transition portion is connected to the round platform body.

Preferably, the transition portion has the shape of a circular cone with a large outer and a small inner along the axis of the anchor hole.

The transition part has the shape of a round platform body with a small inside and a large outside.

Beneficial effects of the present disclosure are as follows:

(1) The present disclosure can realize multi-stage control when slope deformation occurs. If a part of the slope undergoes displacement, the outer sleeves and force resistant bodies in the corresponding position start to work, and these inner sleeves and force resistant bodies are in a non-stressed state, which not only reinforces the slope by piecewise reinforcement increasing the life of the anchor apparatus, but also helps to monitor the deformation of the slope at the corresponding displacement.

(2) When a slope undergoes deformation, a force resistant body with a negative Poisson's ratio structure can strengthen and protect the slope, which can be segmentally reinforced according to the force resistant body in the anchor hole. This is more efficient than the conventional single-force anchor, so that the anchorage function plays well.

(3) When a slope undergoes deformation, the rock mass with the slotted sleeve moving outward produces a relative displacement between the sleeve and round platform body at the corresponding position, which makes the sleeve open and creates more friction between the wall of the anchor hole and round platform body 2 to protect the slope. With an increase in the relative displacement, the friction increases constantly, which can help prevent excessive deformation of the slope. Each part of the present disclosure can produce friction to protect the slope by self-expansion.

DETAILED DESCRIPTION OF THE PREFERRED EMBODIMENT

The present disclosure is further illustrated below with embodiments. It is to be understood that the embodiments are merely illustrative of the present disclosure. In addition, it is to be understood that various modifications and changes may be made to the present disclosure, which are also within the claimed scope of the present disclosure.

Embodiment 1

Figure 1:
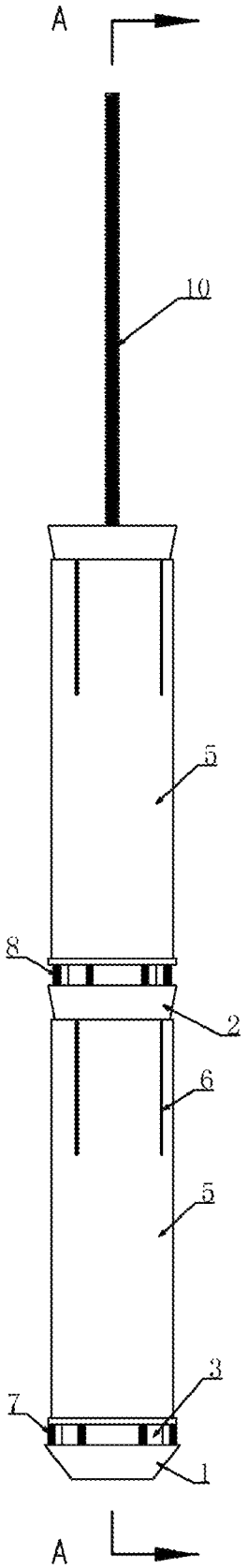
FIG. 1 is an overall structural view of a multi-stage control negative Poisson self-expanding anchor apparatus of the present disclosure.
Figure 2:
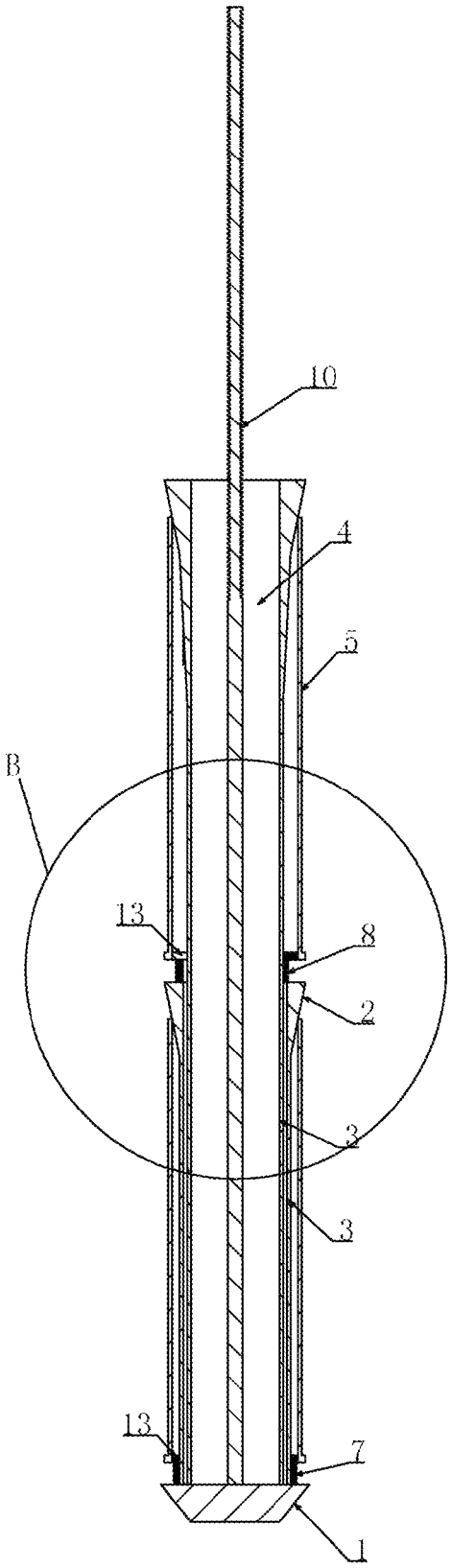
FIG. 2 is an A-A sectional view of FIG. 1.
Figure 3:
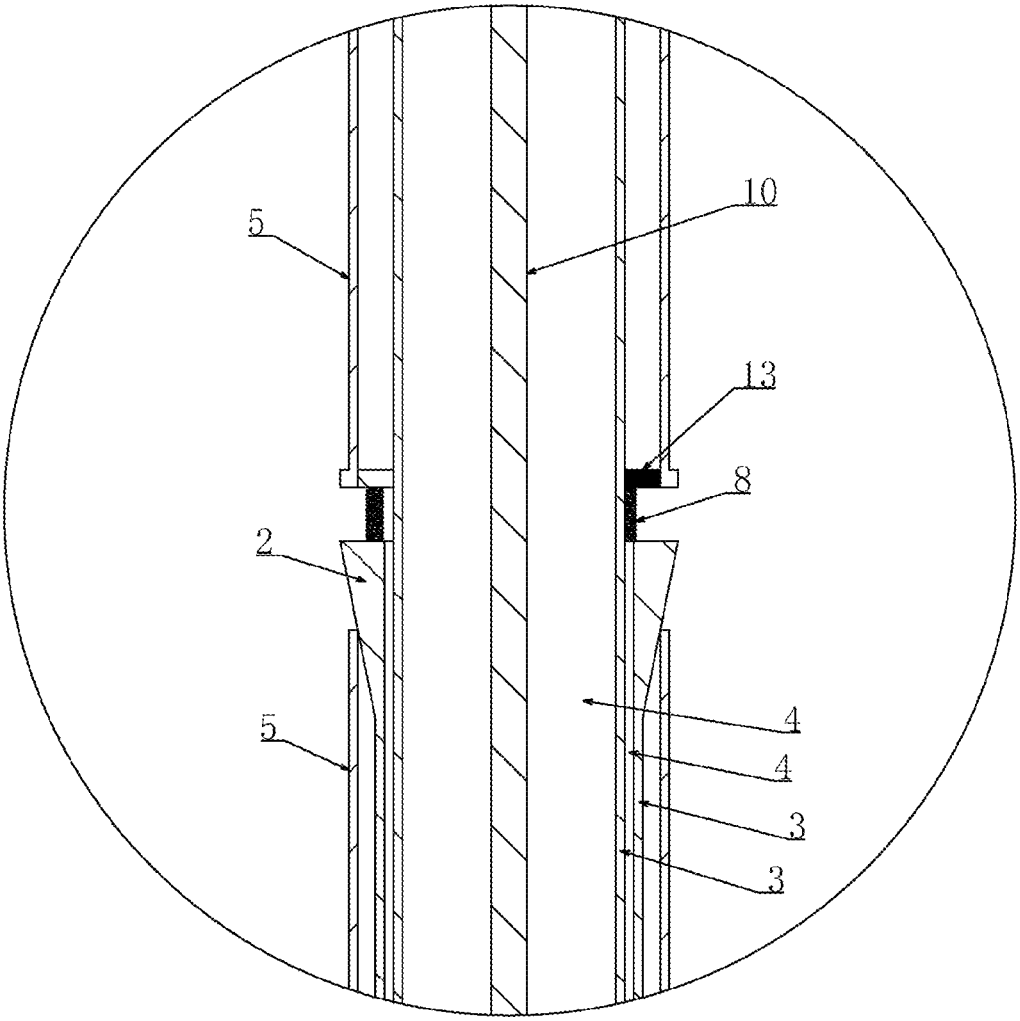
FIG. 3 is an enlarged view of part B of FIG. 2.
Figure 4:
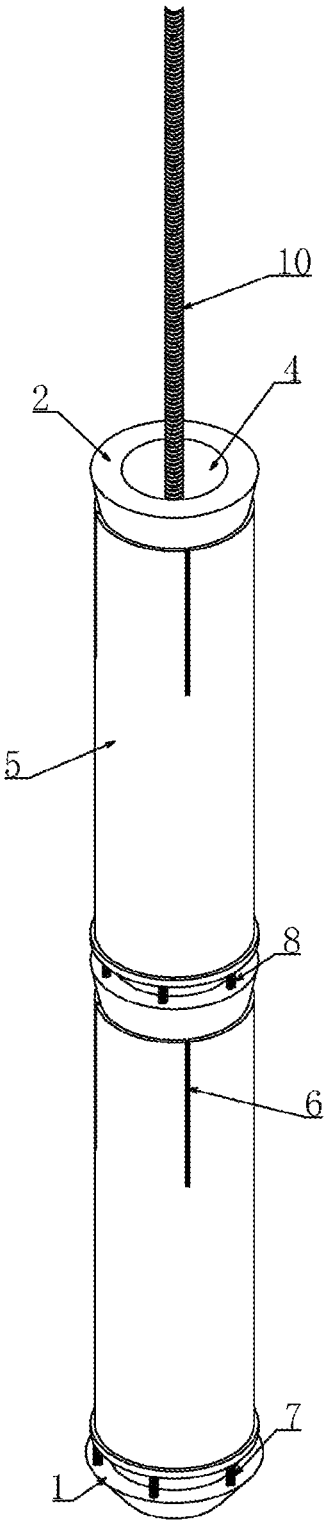
FIG. 4 is a stereoscopic view of the present disclosure.
Figure 5:
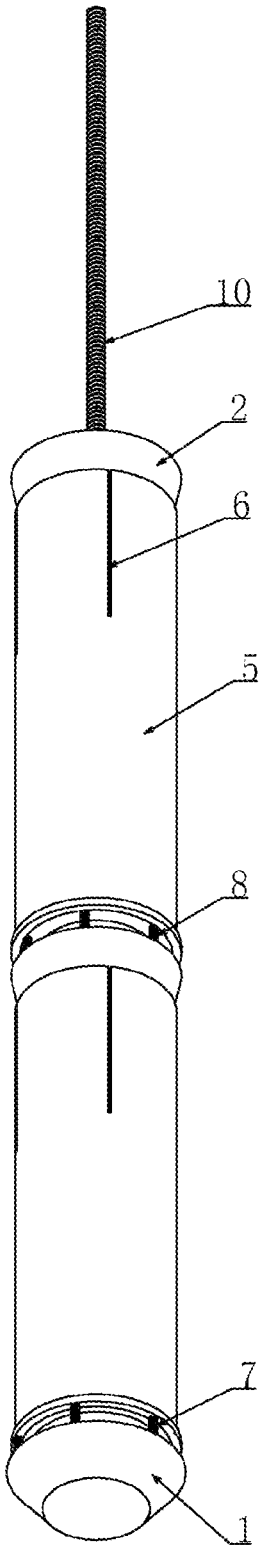
FIG. 5 is a two-dimensional view diagram of the present disclosure.
Figure 6:
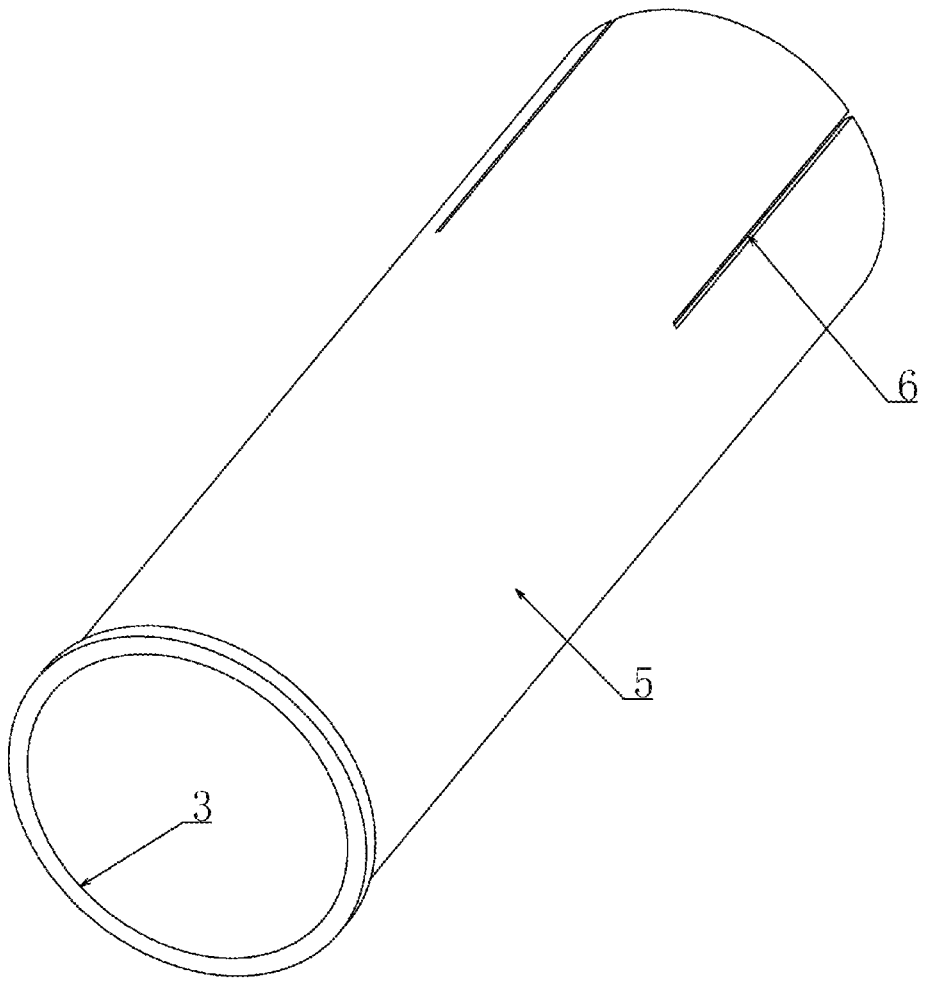
FIG. 6 is a three-dimensional drawing of the sleeve of the present disclosure.
Figure 7:
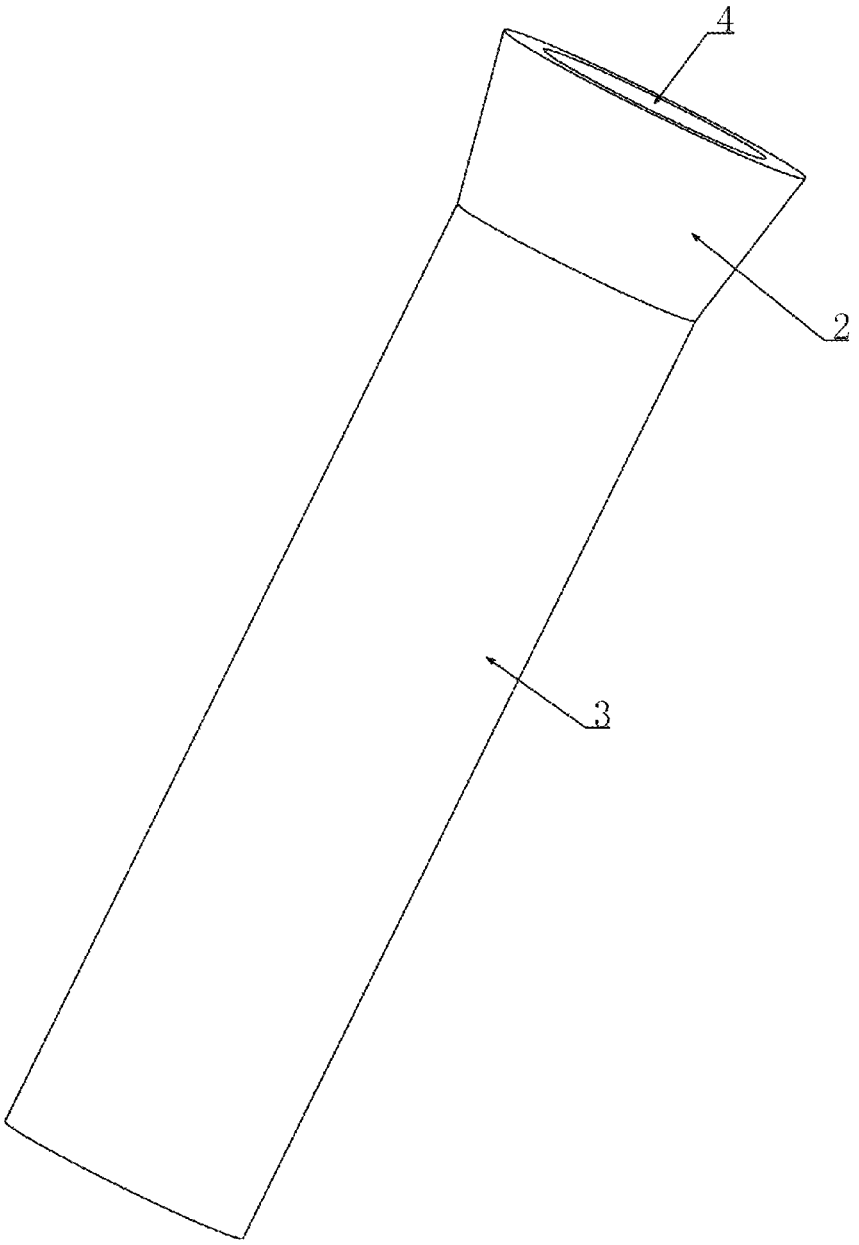
FIG. 7 is a stereogram of the first stage force resistant body of the present disclosure.
Figure 8:
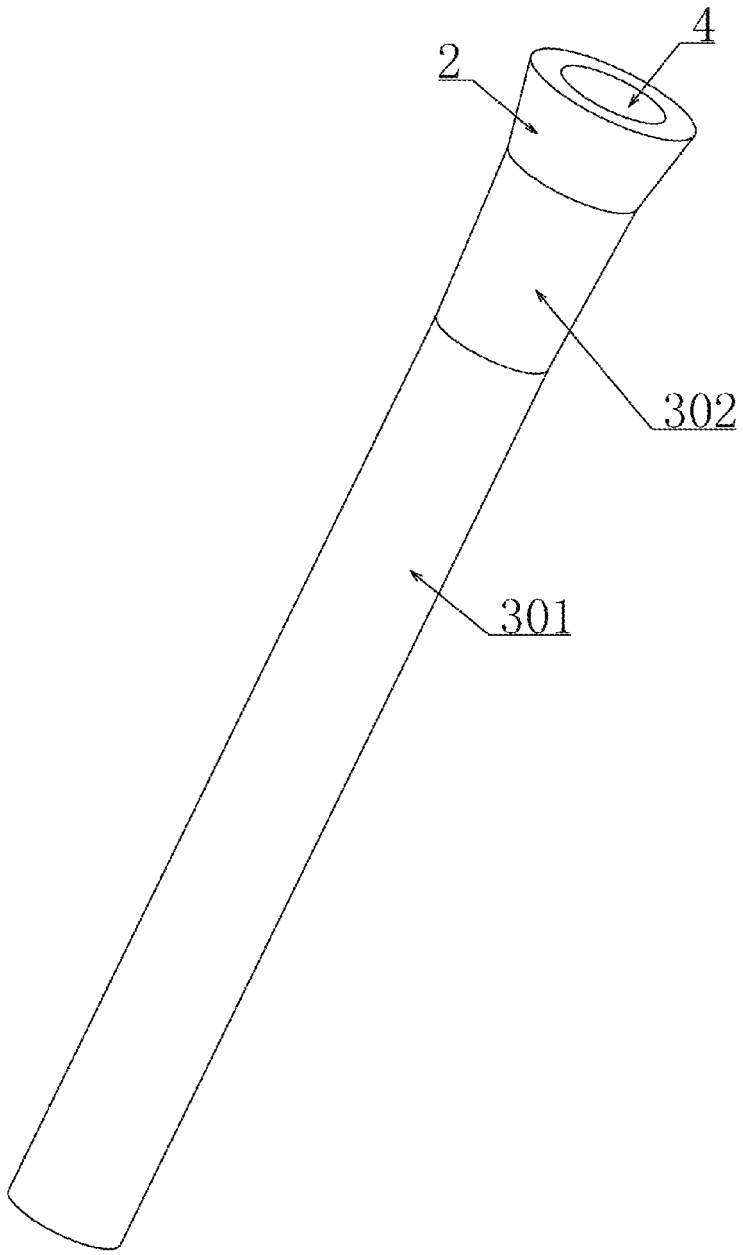
FIG. 8 is a stereogram of the second stage force resistant body of the present disclosure.
Figure 9:
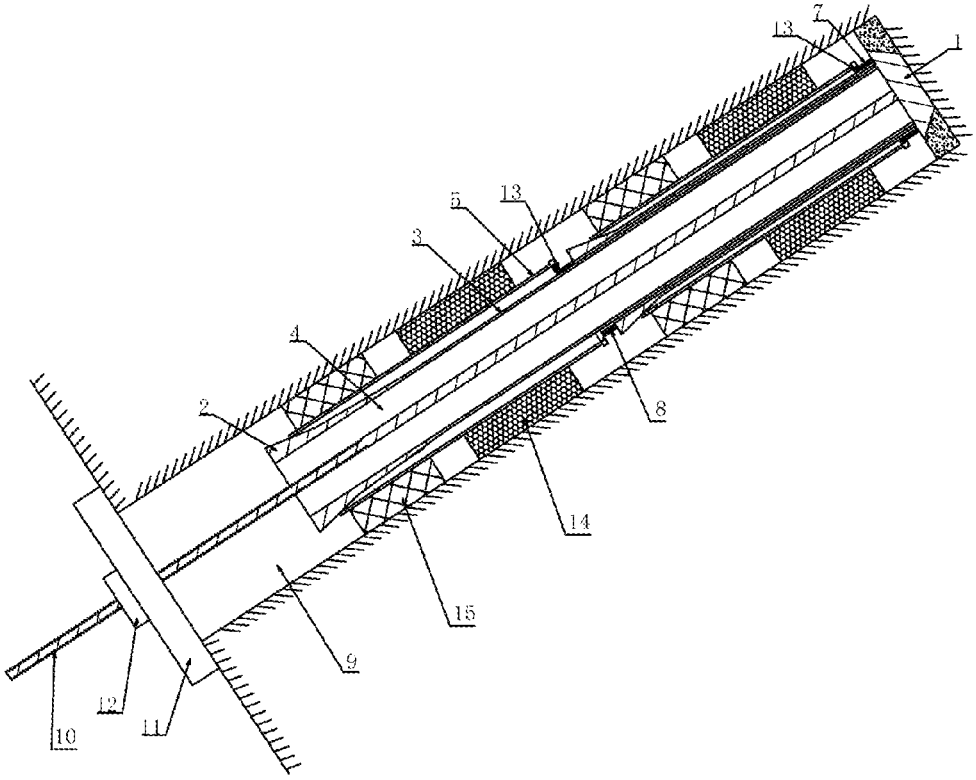
FIG. 9 is a structural diagram of the present disclosure installed in an anchor hole.

Referring to FIG. 9, the embodiment 1 provides a multi-stage control negative Poisson self-expanding anchor apparatus for slope protection, and comprises: an anchorage segment 1, wherein the anchorage segment 1 is arranged in an axial interval with a plurality of axial outward larger and inward smaller sized round platform bodies 2; an axial inner segment of the round platform body 2 is coaxial connected with the force resistant body 3, a hole (4) is arranged in the force resistant body (3); the axial most inner part of the force resistant body 3 is fixed on the anchorage segment 1, the axially outer force resistant body 3 is connected with the axially inner adjacent round platform body 2; the inner segment of the round platform body 2 and the force resistant body 3 are covered with a sleeve 5, wherein the axial outer end of the sleeve 5 has a plurality of slots 6 extending toward the axial inner side; an elastic force bodies 7 is connected between the most inner sleeve 5 and the anchorage segment 1, and an elastic force body 8 is connected between the other sleeve 5 and the round platform body 2.

When an anchor hole 9 is finished, a screw 10 is fixed at anchorage segment 1; a sleeve 5 is set on a force resistant body 3 from the axial inward end to the axial outward end; another sleeve 5 covers another force resistant body 3; then, the second stage force resistant body connects the first stage force resistant body through a hole 4; multiple springs are arranged between the first stage sleeve 5 and the anchorage segment 1, and between the first stage round platform body 2 and the second stage sleeve 5; then, the anchorage segment 1 is anchored at the bottom of the anchor hole.

To attach sleeve 5 with slot 6 on the wall of anchor hole 9, bonding material is grouted at point 14 and 15, as shown in FIG. 9. When the rock mass near the sleeve 5 moves outside, the displacement from the rock mass can drive the corresponding sleeve 5 to move outward along the axis making sleeve 5 at slot 6 open outwards in radial direction due to the round platform body 2; as displacement increasing, the pressure on the wall of anchor hole 9 is constantly increasing in the process of slot opening, so that round platform body 2 squeezing the wall of anchor hole 9 according to sleeve 5 more tightly offers more resistance to prevent rock mass moving outward; the force on round platform body 2 passes on anchorage segment according to the force resistant body 3; the multistage force control features are well implemented.

Many resistance positions of the present disclosure are located inside the anchor hole 9, protected from corrosion by the sun and other external environments. The multi-stage anchorage of the present disclosure can be better realized. Moreover, the movement of specific parts of the slope can be determined by monitoring the changes in the displacement and stress of the anchorage to better protect the stability of the slope.

When inner rock mass undergoes deformation, the outside rock mass from which may follow to deform, and all the force resistant bodies begin to work to prevent the rock mass deforming. When the outermost rock mass underwent displacement, only the force resistant body at the corresponding position began to work. This anchor structure can make these force resistant bodies play a role in reinforcing slope stability. Simultaneously, the anchor structure can increase the life of the force resistant body.

Embodiment 2

According to Embodiment 1, a screw 10, whose inner end is fixed on the anchorage segment, is arranged at the center passing through the hole 4 in round platform body 2, whose outer end is screwed with a screw nut 12 located on a tray 11 fixed on the outside wall of the slope. The screw 10 provides additional protection for the slope reinforcement measure.

When the displacement of the slope reaches a large value, the protection of slope can be implemented using a screw 10, which increases another level of protection of the slope.

The round platform body 2 and force resistant body 3 can be integrated into one structure. The sleeve 5 is a carbon steel expansion tube. Multiple friction bumps can be placed radially outside sleeve 5 at slot 6 to increase the friction with the sidewall of hole 9.

The force resistant body 3, except the innermost, comprises an insertion part 301 with a through hole 4 and a transition portion 302. The insertion part 301 and transition portion 302 share the same diameter at their junction. The outward end of the transition portion 302 is connected to round platform body 2.

The sleeve 5 is bonded on the wall of anchor hole 9, and when the rock mass moves out, the relative displacement between the sleeve 5 bonded with the rock mass and round platform body 2 can make the sleeve open and expand, which produces more friction between the wall of the anchor hole and round platform body 2 to protect the slope.

The anchor apparatus must reinforce the rock mass for a long time. The underground environment is sometimes corrosive, which can reduce the strength, plasticity, toughness, and other mechanical properties of the metal anchor apparatus. Thus, the anchor apparatus is damaged and fails earlier. Therefore, a anticorrosive coating is applied on the surface of the anchor body to separate the surface of the metal component from the soil medium to hinder the corrosion of the microcell on the metal surface layer.

What is claimed is:

1. A multi-stage control negative Poisson self-expanding anchor apparatus comprising:

an anchorage section (1), wherein a plurality of round platform bodies (2) having an axial outer end larger than an axial inner end is disposed on outside of the anchorage section (1); wherein the axial inner end is coaxial connected with a force resistant body (3), wherein the force resistant body (3) comprises an innermost end, and the innermost end of the force resistant body (3) is fixed on the anchorage section (1), and the axial outer end of the each of the round platform bodies (2) is arranged a through-hole (4) through the force resistant body (3) and the each of the round platform bodies (2);

a sleeve (5) comprising an innermost end, wherein the sleeve covers around the force resistant body (3), and the sleeve comprises a plurality of slots (6) extending toward an inner axial side; of the sleeve (5); and a first elastic force body (7) that is connected between the innermost end of the sleeve (5) and the anchorage segment (1), and a second elastic force body (8) that is connected between another sleeve (5) next to the sleeve (5) and the axial outer end of the each of the round platform bodies (2).

2. The multi-stage control negative Poisson self-expanding anchor apparatus according to claim 1, wherein the anchorage section (1) is anchored at an axial innermost part of an anchoring hole (9), a side wall of the sleeve (5) with each of the slots (6) is fixed on a wall of the anchoring hole (9), and an inner wall of the anchoring hole (9) at the each of the slot (6) is attached to the sleeve (5).

3. The multi-stage control negative Poisson self-expanding anchor apparatus according to claim 1, wherein both the first elastic body (7) and the second elastic body (8) are springs.

4. The multi-stage control negative Poisson self-expanding anchor apparatus according to claim 1, wherein the each of the round platform bodies (2) and the force resistant body (3) are an integrated structure.

5. The multi-stage control negative Poisson self-expanding anchor apparatus according to claim 1, wherein the force resistant body (3) comprises an insertion part (301) with the through-hole (4) and a transition portion (302) connected to the outer end of the insertion part (301); and a diameter of the outer end of the transition portion (302) is equal to the diameter of the outer end of the innermost end of the resistant body (3); the outer end of the transition portion (302) is connected to the each of the round platform bodies (2).

6. The multi-stage control negative Poisson self-expanding anchor apparatus according to claim 5, wherein the transition portion (302) has the shape of a circular cone having an outer size larger than the an inner size along an axis.

7. The multi-stage control negative Poisson self-expanding anchor apparatus according to claim 6, wherein an anticorrosive coating is applied on a surface of the anchor apparatus.

* * * * *